US005400761A

United States Patent [19]

Fukasawa et al.

[11] Patent Number: 5,400,761

[45] Date of Patent: Mar. 28, 1995

[54] AIR-FUEL RATIO CONTROL APPARATUS OF INTERNAL COMBUSTION ENGINE

[75] Inventors: Osamu Fukasawa, Obu; Junya Morikawa, Kasugai; Hisashi Iida, Aichi, all of Japan

[73] Assignee: Nippondenso Co., Ltd., Kariya, Japan

[21] Appl. No.: 166,993

[22] Filed: Dec. 16, 1993

[30] Foreign Application Priority Data

Dec. 18, 1992 [JP] Japan ..... 4-338647

[51] Int. Cl.[6] ..... F02M 51/00

[52] U.S. Cl. ..... 123/674

[58] Field of Search ..... 123/674, 491; 364/431.1; 60/276

[56] References Cited

U.S. PATENT DOCUMENTS

| | | | |
|---|---|---|---|
| 5,033,439 | 7/1991 | Eygret | 123/491 |
| 5,048,493 | 9/1991 | Orzel et al. | 123/674 |
| 5,074,271 | 12/1991 | Suzuki et al. | 123/491 |
| 5,099,813 | 3/1992 | Kurosu et al. | 123/491 |
| 5,107,431 | 4/1992 | Ohta et al. | 364/431.1 |
| 5,243,951 | 9/1993 | Nakaniwa | 123/674 |
| 5,299,550 | 4/1994 | Inoue | 123/674 |
| 5,318,003 | 6/1994 | Kadota | 123/674 |
| 5,320,080 | 6/1994 | Kadowaki | 123/674 |
| 5,337,557 | 8/1994 | Toyoda | 60/276 |

FOREIGN PATENT DOCUMENTS

| | | |
|---|---|---|
| 62-233466 | 10/1987 | Japan . |
| 63-129159 | 6/1988 | Japan . |
| 2130240 | 5/1990 | Japan . |

*Primary Examiner*—Raymond A. Nelli

*Attorney, Agent, or Firm*—Cushman, Darby & Cushman

[57] ABSTRACT

An air-fuel ratio control apparatus of an internal combustion engine capable of learning and controlling an air-fuel ratio accurately both in idling and non-idling without being affected by concentration of evaporated fuel. Uniform deviation of an air-fuel ratio is detected before starting purging of the evaporated fuel (steps S133 to S137), air-fuel ratio learning values $KGI_0$ to $KGI_7$ and $KGS_0$ to $KGS_7$ are stored respectively so that the uniform deviation shows a predetermined value or lower both at idling time and at non-idling time (steps S138 to S142), and air-fuel learning values $KG_0$ to $KG_7$ in respective areas including idling are updated or renewed with a value obtained by leveling or averaging air-fuel ratio learning values $KGI_0$ to $KGI_7$ and $KGS_0$ to $KGS_7$ stored both at idling time and at non-idling time (step S145). Thereafter, purging of the evaporated fuel is started, and area learning of the air-fuel ratio is also executed by air-fuel ratio learning values $KG_0$ to $KG_7$ in respective areas.

5 Claims, 16 Drawing Sheets

| NE \ PM | 291 | 369 | 447 | 525 | 603 | 651 | 759 |
|---|---|---|---|---|---|---|---|
| 800 | 20.1 | 14.5 | 11.2 | 8.6 | 6.2 | 4.6 | 0.0 |
| 1200 | 12.5 | 9.3 | 7.2 | 5.5 | 4.0 | 2.9 | 0.0 |
| 1600 | 9.3 | 6.8 | 5.3 | 4.0 | 2.9 | 2.1 | 0.0 |
| 2000 | 7.9 | 5.7 | 4.4 | 3.3 | 2.4 | 1.8 | 0.0 |
| 2400 | 6.0 | 4.5 | 3.5 | 2.6 | 1.9 | 1.4 | 0.0 |
| 2800 | 5.5 | 4.1 | 3.1 | 2.3 | 1.7 | 1.2 | 0.0 |
| 3200 | 4.9 | 3.6 | 2.7 | 2.0 | 1.5 | 1.1 | 0.0 |
| 3600 | 4.1 | 3.0 | 2.2 | 1.7 | 1.3 | 0.9 | 0.0 |
| 4000 | 3.4 | 2.4 | 1.8 | 1.4 | 1.1 | 0.8 | 0.0 |

(mmHg)

(rpm)

| | | | | |
|---|---|---|---|---|
| PM ↑ | $KGI_1$ | $KGI_3$ | $KGI_5$ | $KGI_7$ |
| | $KGI_0$ | $KGI_2$ | $KGI_4$ | $KGI_6$ |
| | | | → NE | |

| | | | | |
|---|---|---|---|---|
| PM ↑ | $KGS_1$ | $KGS_3$ | $KGS_5$ | $KGS_7$ |
| | $KGS_0$ | $KGS_2$ | $KGS_4$ | $KGS_6$ |
| | | | → NE | |

| | | | | |
|---|---|---|---|---|
| PM ↑ | $KG_1$ | $KG_3$ | $KG_5$ | $KG_7$ |
| | $KG_0$ | $KG_2$ | $KG_4$ | $KG_6$ |
| | | | → NE | |

AIR-FUEL RATIO CONTROL APPARATUS OF INTERNAL COMBUSTION ENGINE

BACKGROUND OF THE INVENTION

The present invention relates to an air-fuel ratio control apparatus for an internal combustion engine constructed for sucking evaporated fuel generated in a fuel tank into an intake side of the internal combustion engine so as to burn the evaporated fuel.

There has been an apparatus in which evaporated fuel generated in a fuel tank is stored in a canister, and the evaporated fuel stored in the canister is discharged together with air to an intake side of an internal combustion engine so as to be burnt, in which the quantity of discharged fuel, i.e., canister purge quantity is varied by a fixed value and concentration of the evaporated fuel sucked into the intake side of the internal combustion engine from the canister is detected by the variation of an air-fuel ratio at that time, thereby to correct an air-fuel ratio learning value in accordance with this concentration (e.g., JP-A-2-130240).

In a conventional apparatus described above, however, there is a problem that correct air-fuel ratio learning in a plurality of learning areas (both in idling and non-idling in particular) cannot be sufficiently be done since the concentration of the evaporated fuel is high at the initial stage of purging, and the variation of an air-fuel ratio feedback value due to the influence by the evaporated fuel becomes larger than the variation of the air-fuel ratio feedback value to be learnt, and the concentration of the evaporated fuel has not yet been detected correctly at the initial stage of the start of purging.

A U.S. patent application Ser. No. 52926 entitled "Air-Fuel Ratio Control Apparatus of Internal Combustion Engine" was filed on Apr. 27, 1993 on the basis of Japanese patent application No. 4-109592 and assigned to the present assignee.

SUMMARY OF THE INVENTION

It is an object of the present invention to learn an air-fuel ratio accurately in a plurality of operating areas including idle time and non-idle time without being affected by evaporated fuel of high concentration.

According to one aspect of this invention, an air-fuel ratio of fuel-air mixture supplied to an internal combustion engine is feedback controlled by air-fuel ratio feedback means in accordance with the air-fuel ratio detected by air-fuel ratio detecting means, and purge rate of air containing evaporated fuel discharged to an intake side of the internal combustion engine from a canister through a discharge passage is controlled by purge rate control means in accordance with operating state of the engine. Then, fuel quantity is corrected by purge reacting fuel quantity correcting means so that the air-fuel ratio shows a predetermined value in accordance with evaporated fuel concentration detected by concentration detecting means and the purge rate by the purge rate control means. Further, a plurality of operating areas including idling and non-idling of the internal combustion engine are detected by operating area detecting means, and learning values of the air-fuel ratio are stored in learning value storage means in accordance with the plurality of operating areas. Then, the fuel quantity is increased or decreased by uniform learning control means so that the deviation from the reference value detected by deviation detecting means shows a predetermined value or below at both times when the operation state of the internal combustion engine is detected to be idling and when it is detected to be non-idling by the operating area detecting means before purge rate control by the purge rate control means is started. The learning value in learning value storage means is renewed based on increase or decrease quantity of fuel of the uniform learning control means when the deviation shows a predetermined value or below at both times when the operation state of the internal combustion engine is detected to be idling and when it is detected to be non-idling by the operating area detecting means by the increase and decrease of the fuel quantity of the uniform learning control means. Then, the start of purge rate control by purge rate control means is permitted by purge start permit means after renewal of the learning value by uniform learning value renewal means, and the learning values of the learning value storage means are also renewed by areas by the learning value renewal by area means based on the air-fuel ratio feedback value by the air-fuel ratio feedback control means.

As described above, according to the present invention, purging is started after renewal of the air-fuel ratio learning value in at least two areas of idling time and non-idling time. Thus, there is such an excellent effect that it is possible to learn an air-fuel ratio accurately in a plurality of operating areas including idling time and non-idling time without being affected by evaporated fuel having high concentration, and to prevent deterioration of the air-fuel ratio or operation performance in individual area.

DESCRIPTION OF THE PREFERRED EMBODIMENTS

Figure 1:
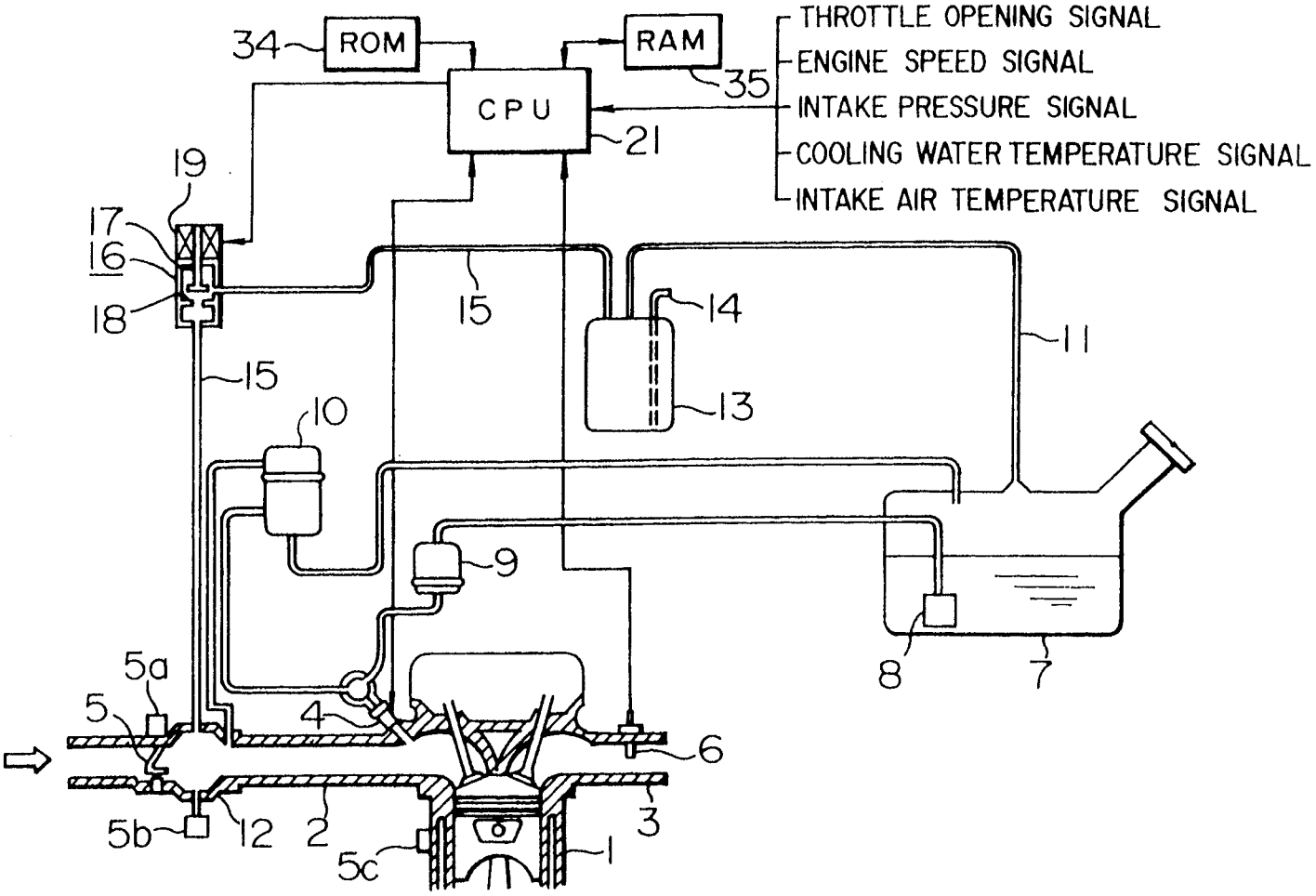
FIG. 1 is a general block diagram showing an embodiment of the present invention.

As shown in FIG. 1, a multi-cylinder engine 1 is mounted on a vehicle, and an intake pipe 2 and an exhaust pipe 3 are connected to the engine 1. An electromagnetic injector 4 is provided at the inner end portion of the intake pipe 2, and a throttle valve 5 is also provided on the upstream side thereof. Furthermore, an oxygen sensor 6 is provided in the exhaust pipe 3 as air-fuel ratio detecting means, and the sensor 6 outputs a voltage signal corresponding to oxygen concentration in the exhaust gas.

A fuel feed system for feeding the fuel to the injector 4 includes a fuel tank 7, a fuel pump 8, a fuel filter 9 and a pressure regulating valve 10. Thus, the fuel (gasoline) in the fuel tank 7 is fed by pressure to the injector 4 of each cylinder through the fuel filter 9 by means of the fuel pump 8, and the fuel fed to each injector 4 is regulated to a predetermined pressure by means of the pressure regulating valve 10.

A purge pipe 11 extending from the top part of the fuel tank 7 is made to communicate with a surge tank 12 of the intake pipe 2, and a canister 13 containing activated charcoal as an adsorbent for adsorbing the evaporated fuel generated in the fuel tank is disposed midway in the purge pipe 11. Further, a hole 14 opening to the atmosphere for introducing fresh air is provided on the canister 13. The purge pipe 11 serves as a bleedoff or discharge passage 15 on the surge tank 12 side of the canister 13, and a variable flow rate electromagnetic valve 16 (hereinafter referred to as a purge solenoid valve) is provided midway in the bleedoff passage 15. In the purge solenoid valve 16, a valve body 17 is always urged toward a direction of closing a seat portion 18 by means of a spring not illustrated, but the valve body 17 opens the seat portion 18 by exciting a coil 19. Thus, the bleedoff passage 15 is closed by deenergization of the coil 19 of the purge solenoid valve 16, and the bleedoff passage 15 is opened by exciting the coil 19. The opening of the purge solenoid valve 16 is regulated by means of a CPU 21 which is described later by duty ratio control based on pulse width modulation.

Figures 2, 3:
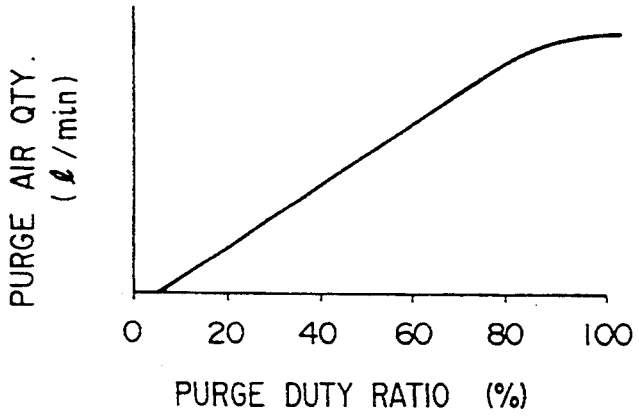
FIG. 2 is a characteristic diagram of a purge solenoid valve in the embodiment.
FIG. 3 is a full admission purge rate map in the embodiment.

Accordingly, when a control signal is applied to the purge solenoid valve 16 from the CPU 21, and the canister 13 is made to communicate with the intake pipe 2 of the engine 1, new air $Q_a$ is introduced from the atmosphere, which ventilates the inside of the canister 13 and is fed into the cylinder through the intake pipe 2 of the engine 1, thus performing canister purge, thereby to recover the adsorbing function of the canister 13. The introduced quantity $Q_p$ (1/min) of the new air $Q_a$ at this time is regulated by changing the duty of a pulse signal applied to the solenoid valve 16 from the CPU 21. FIG. 2 is a characteristic diagram of the purge quantity at this time, and shows the relationship between the duty and the purge quantity of the purge solenoid valve 16 in case a negative pressure in the intake pipe is constant. It is realized from this diagram that, as the duty of the purge solenoid 16 is increased from 0%, the purge quantity, i.e., the quantity of air sucked into the engine 1 through the canister 13 increases almost linearly.

The CPU 21 receives a throttle opening signal from a throttle sensor 5a for detecting the opening of the throttle valve 5, an engine speed signal from an engine speed sensor not illustrated for detecting the speed of the engine 1, an intake pressure signal from an intake pressure sensor 5b (which may be an intake air quantity signal from an intake air quantity sensor) for detecting the pressure of the intake air which has passed through the throttle valve 5, a cooling water temperature signal from a water temperature sensor 5c for detecting the temperature of engine cooling water, and an intake temperature signal from an intake temperature sensor not illustrated for detecting the intake air temperature.

Further, the CPU 21 receives a signal (voltage signal) from the oxygen sensor 6, and decides whether the air-fuel mixture is rich or lean. Further, the CPU 21 changes (skips) the feedback correction factor step-wise in order to increase or decrease the fuel injection quantity when rich is inverted to lean or when lean is inverted to rich, and increases or decreases the feedback correction factor gradually in case of rich or lean. Besides, such feedback control is not conducted when the engine cooling water temperature is low and at time of running with a high load and at high engine revolutions. Further, the CPU 21 obtains a basic injection time by the engine speed and the intake pressure, obtains a final injection time TAU by performing correction by a feedback correction factor or the like on the basic injection time, and has fuel injection performed at a predetermined injection timing by the injector 4.

A ROM 34 stores programs and maps for controlling the operation of the whole engine. A RAM 35 temporarily stores various data such as detected data of the opening of the throttle valve 5, an engine speed or the like. Then, the CPU 21 controls the operation of the engine based on the programs in the ROM 34.

FIG. 3 shows a full admission purge rate map, which is determined by an engine speed Ne and a load (which is an intake pipe pressure in this case, and may be an intake air quantity or a throttle opening instead). This map shows a ratio of the air quantity flowing through the bleedoff passage 15 at 100% duty of the purge solenoid valve 16 to the total air quantity flowing into the engine 1 through the intake pipe 2, and is stored in the ROM 34.

The present system is operated through air-fuel ratio feedback (FAF) control, purge rate control, evaporated fuel concentration detection, fuel injection quantity control, air-fuel ratio learning control and purge solenoid valve control.

The operation of the embodiment will be described hereinafter with respect to every control.

AIR-FUEL RATIO FEEDBACK CONTROL

The air-fuel ratio feedback control will be described with reference to FIG. 4. This air-fuel ratio feedback control is executed in accordance with a base routine of the CPU 21 at intervals of 4 ms.

First, it is determined whether the feedback (F/B) control is possible or not in a step S40. The F/B conditions in this case satisfy all of conditions shown hereunder principally.

That is, (1) not the time of starting, (2) not during fuel cut-off, (3) cooling water temperature (THW)≧40° C., (4) $TAU > TAU_{min}$, and (5) an oxygen sensor 6 being in an activated state.

If these conditions are satisfied, the process proceeds to a step S42, where an oxygen sensor output and a predetermined decision level are compared with each other, and an air-fuel ratio flag XOXR is manipulated with a delay time (H and I msec), respectively. For example, it is assumed to be rich when XOXR=1, and to be lean when XOXR=0. Next, the process proceeds to a step S43, where a feedback value, FAF, is manipulated based on XOXR described above. Namely, when XOXR changes from 0 to 1 or from 1 to 0, the value of FAF is made to skip by a predetermined quantity, and while XOXR continues to be 1 or 0, integral control of the FAF value is performed. Then, after the process proceeds to a step S44 and upper and lower limits of the FAF value are checked, the process proceeds to a step S45, where smoothing (averaging) processing is performed every skip or at intervals of predetermined time, thereby to obtain a smoothed feedback value, FAFAV. Besides, in case feedback control is not effected in the step S40, the process proceeds to a step S46, where the FAF value is set to 1.0 by which no feedback control is performed in effect.

PURGE RATE CONTROL

Figure 5:
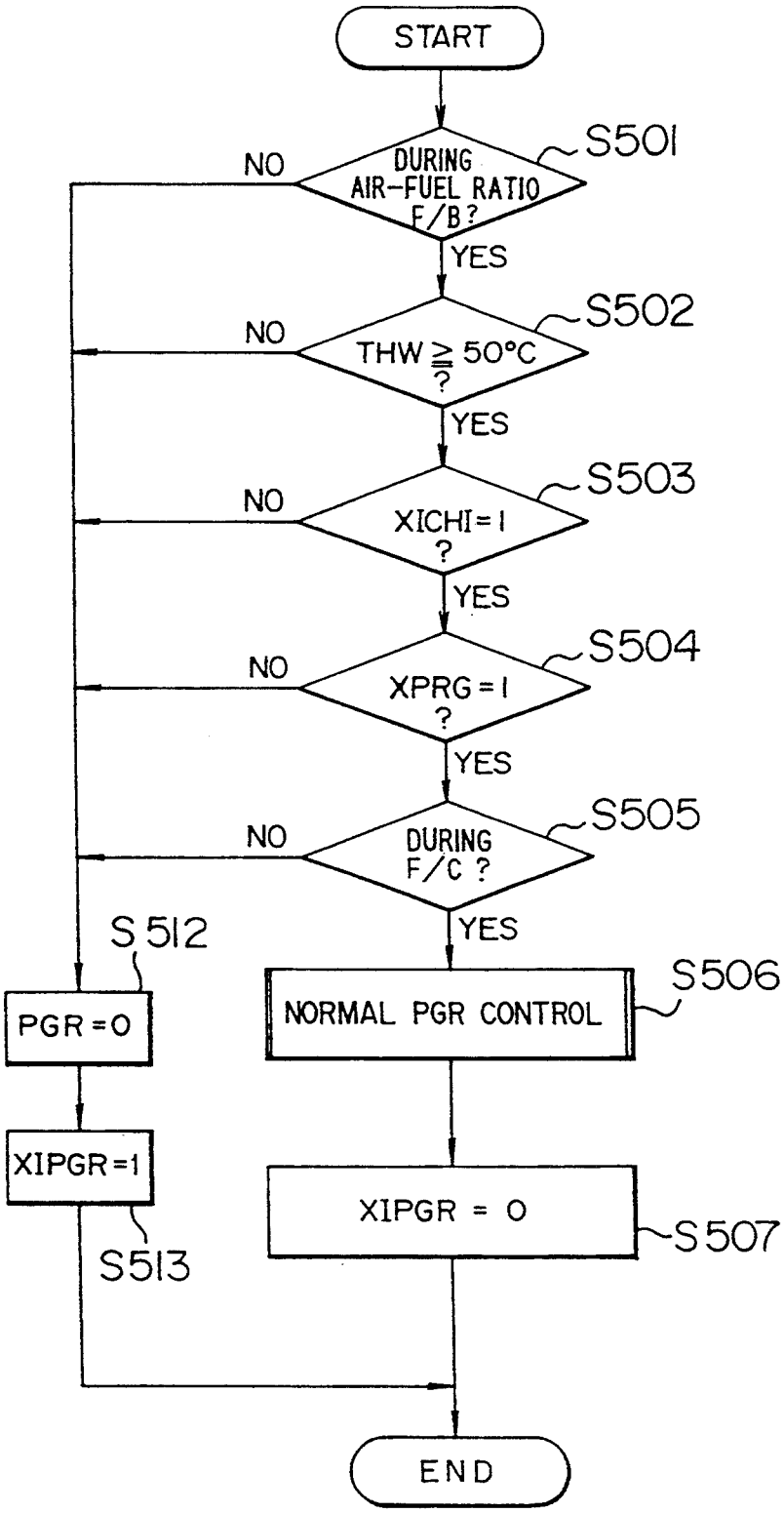
FIG. 5 is a flow chart showing purge rate control in the embodiment.

A main routine of purge rate control is shown in FIG. 5. This routine is also executed every 4 ms in accordance with the base routine of the CPU 21.

It is determined in a step S501 whether or not the air-fuel ratio feedback (F/B) is performed in the same manner as in the step S40, and it is also determined in a step S502 whether cooling water temperature is 50° C. or higher or not. In case of during air-fuel ratio F/B and when the water temperature is a predetermined value 50° C. or higher, it is determined in a next step S503 whether uniform deviation detection has been terminated or not by a fact whether the uniform deviation end flag XICHI in FIG. 13 which will be described later is 1 or not, and it is determined in a step S504 whether purge control is possible when it is determined that uniform deviation detection is terminated by a fact whether a purge execution flag XPRG is 1. When it is possible to execute purging, it is determined in a step S505 whether during fuel cut or not, and when it is determined it is not during fuel cut, the process proceeds to a step S506 and normal purge rate control is made, and thereafter a purge unexecuted flag XIPGR is set to zero in a step S507 in order to execute purge rate control. Besides, when purge rate conditions are not effected in steps S501, S502, S503, S504 and S505, the process proceeds to a step S512 and the purge rate is set to zero, and the process proceeds to a step S513 thereafter, and the purge unexecuted flag XIPGR is set to 1.

Figure 6:
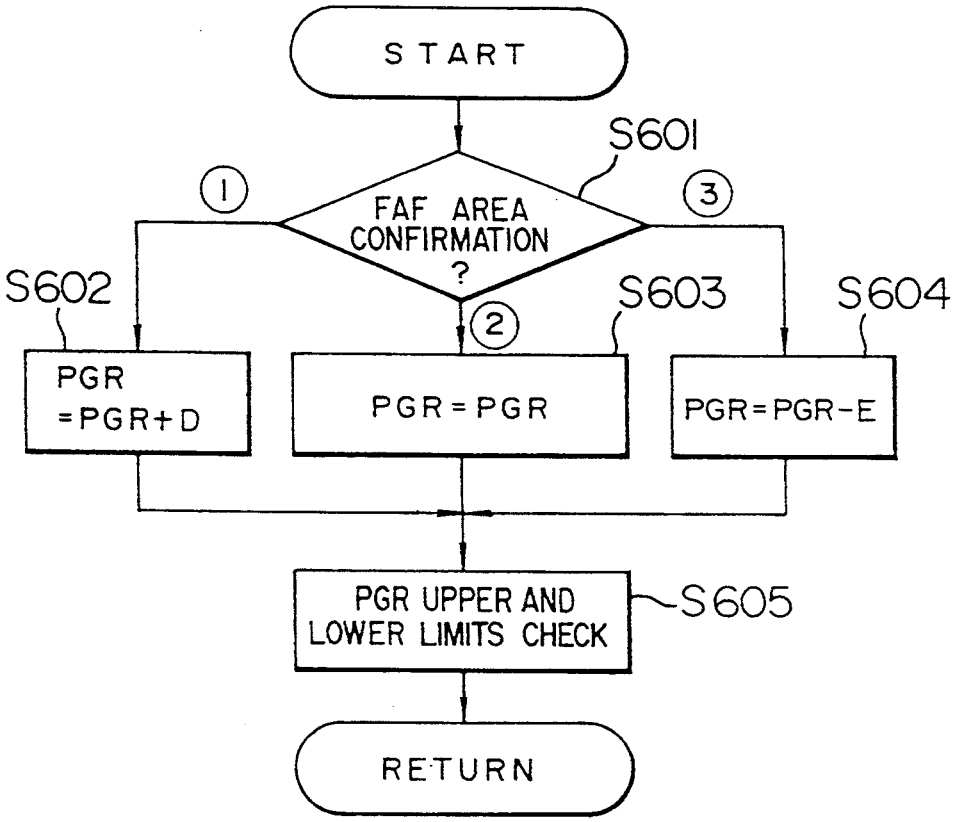
FIG. 6 is a flow chart showing ordinary purge rate control subroutine in the embodiment.
Figure 7A:
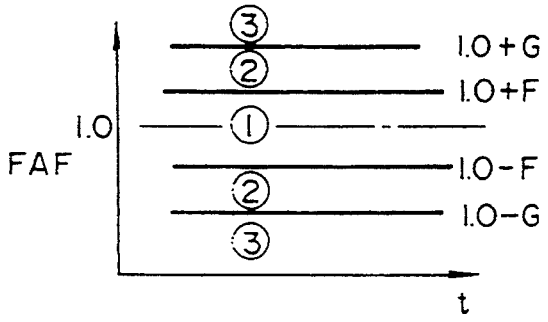
FIGS. 7A to 7E are various characteristic diagrams normally used for purge rate control subroutines in the embodiment.

A normal purge rate (PGR) control subroutine in a step S506 in FIG. 5 is shown in FIG. 6. First, in a step S601, it is detected in which area among three areas (①, ②, ③) the FAF value (or a FAF smoothed value) is located with respect to the reference value 1.0. Here, as shown in FIG. 7A, the area ① shows the FAF value is within 1.0±F%, the area ② shows the FAF value is apart from or beyond 1.0±F% and within ±G% (where, F<G), and the area ③ shows the FAF value is located at 1.0±G% or more.

Figure 7C:
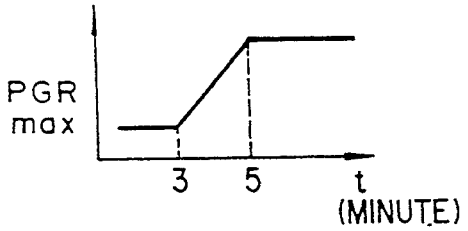
Figure 7B:
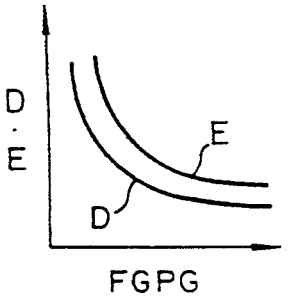
Figure 7D:
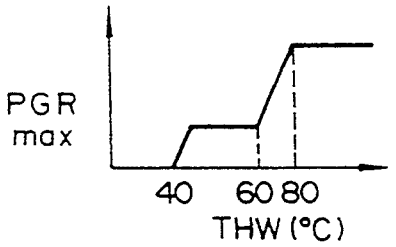
Figure 7E:
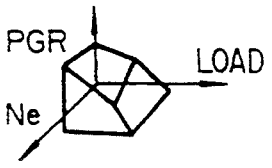

In the case of the area ①, the process proceeds to a step S602, and the purge rate (PGR) is increased by a predetermined value D% at a time. In the case of the area ②, the process proceeds to a step S603, and nothing is changed in PGR. In the case of the area ③, the process proceeds to a step S604, and PGR is reduced by a predetermined value E% at a time. Here, it is desirable to change the predetermined values D and E in accordance with the evaporative concentration (FGPG) as shown in FIG. 7B. Then, upper and lower limits of PGR are checked in a next step S605. Here, the upper limit value shall be of the smallest value among various conditions such as purge starting time shown in FIG. 7C, water temperature shown in FIG. 7D and operating conditions (full admission purge rate map) shown in FIG. 7E.

PURGE EXECUTION CONTROL

Figure 8:
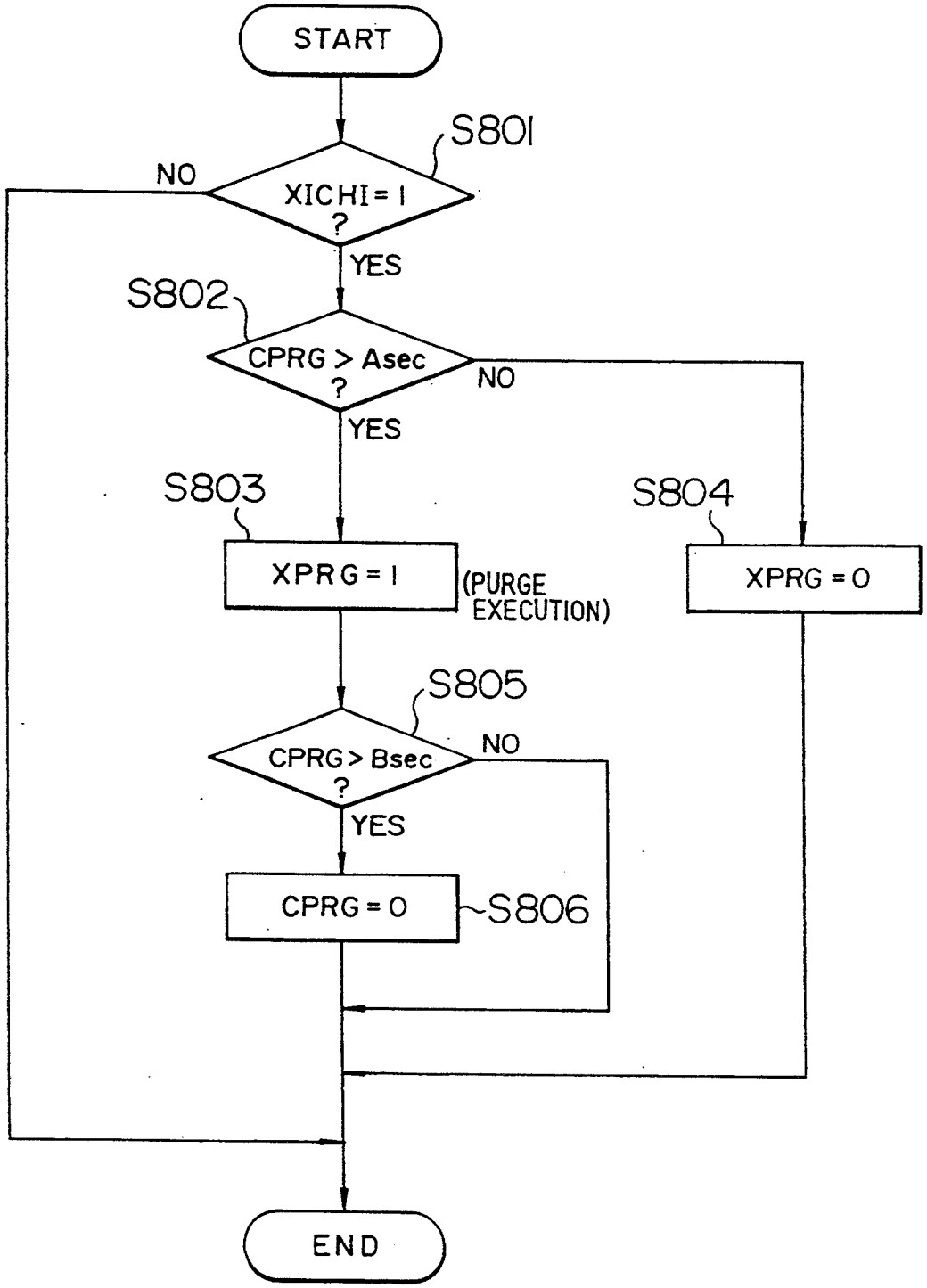
FIG. 8 is a flow chart of purge execution control in the embodiment.

A control routine of a purge execution flag XPRG for determining whether purge control in the step S504 shown in FIG. 5 executed by time interruption at every second by means of the CPU 21 is possible or not is shown in FIG. 8.

First, it is determined in a step S801 whether the uniform deviation end flag XICHI is 1. When it is determined that uniform deviation detection has been terminated, it is determined in a step S802 whether A seconds (300 seconds for instance) or more have elapsed, and the purge execution flag XPRG is set to 1 in a step S803 when A seconds or more have elapsed. When A seconds or more have not elapsed in the step S802, the process proceeds to a step S804, the purge execution flag XPRG is set to 0, and air-fuel learning by learning value renewal by area is executed in the interim through a routine in FIG. 14 which will be described later. That is to say, it means that purge control and air-fuel ratio learning control are repeated at intervals of a predetermined time (A seconds). Then, after the purge execution flag is set to 1 in the step S803, it is determined in a step S805 whether B seconds (A×2) have elapsed, and a counter CPRG for measuring A seconds and B seconds after elapsed is reset, thus ending the process.

EVAPORATIVE CONCENTRATION DETECTION

Figure 10:
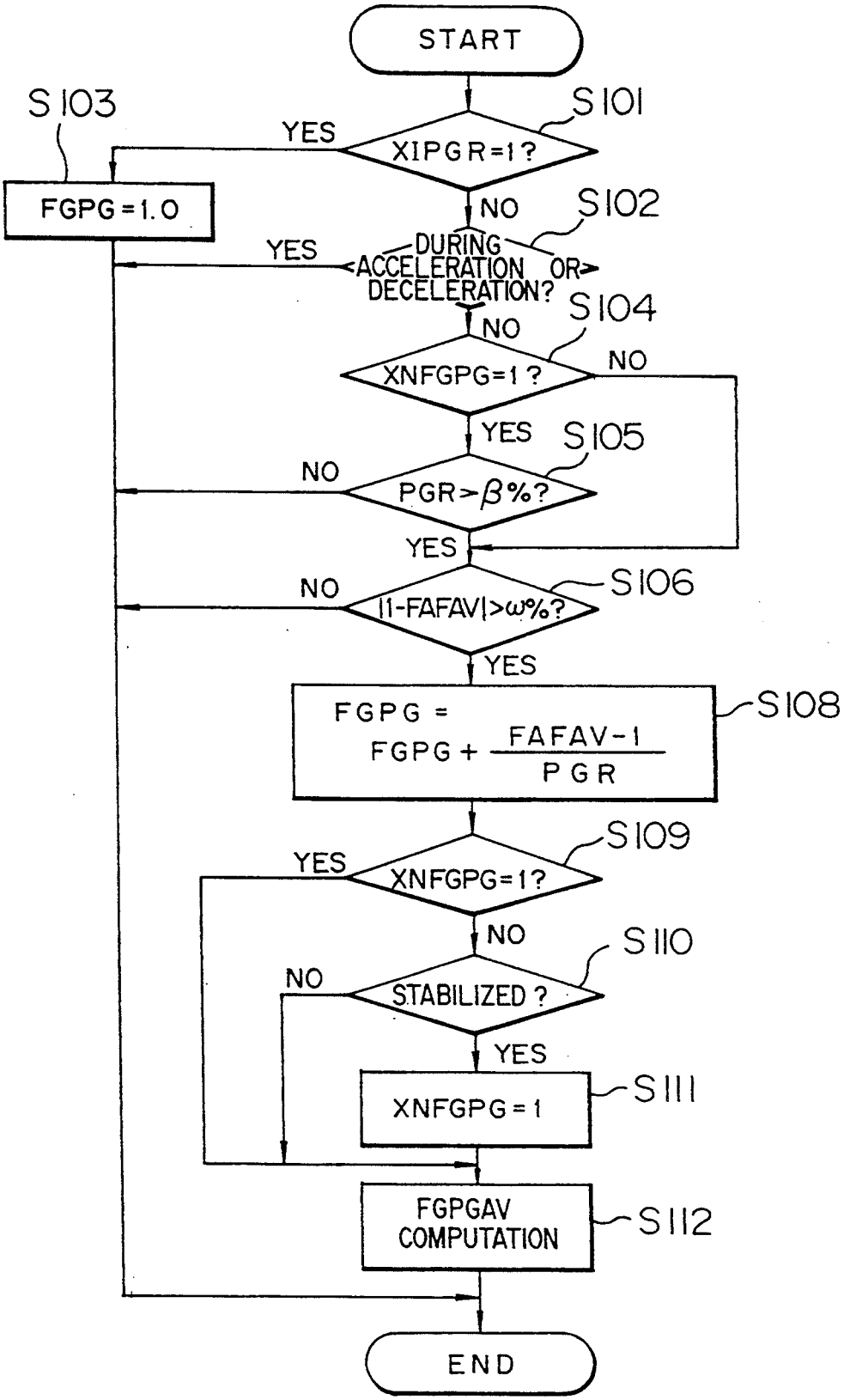
FIG. 10 is a flow chart showing evaporative concentration detection in the embodiment.

A main routine of evaporative concentration detection executed approximately every 4 ms in the base routine of the CPU 21 is shown in FIG. 10. First, when purge control has been started and the purge unexecuted flag XIPGR is not 1 in a step S101, the process proceeds to a step S102, and, when the flag XIPGR is 1 and purge control has not been started as yet, the process proceeds to a step S103 and the evaporative concentration FGPG is set to a reference value 1.0, thus completing the process. Further, it is determined whether during speed adjustment or not in the step S102. Here, determination whether during speed adjustment or not may be made by a generally well known method by detecting an idle switch, throttle valve opening variation, intake pipe pressure variation, vehicle speed or the like.

Further, when it is determined to be during acceleration in the step S102, the process is terminated as it is. When it is determined to be not during acceleration, the process proceeds to a step S104, where it is determined whether an initial concentration detection end flag XNFGPG is 1. When the flag is 1, the process proceeds to a next step S105, and when the flag is not 1, the process proceeds to a step S106 bypassing the step S105. Besides, it is sufficient to initially set this initial concentration detection end flag XNFGPG to 0 when a key switch is turned on. Then, when the initial concentration detection has not been terminated, it is determined in the step S105 whether the purge rate PGR is at a predetermined value ($\beta$%) or higher, and the process is terminated as it is when PGR is not higher than $\beta$% and the process proceeds to a next step S106 when it is higher.

Figure 4:
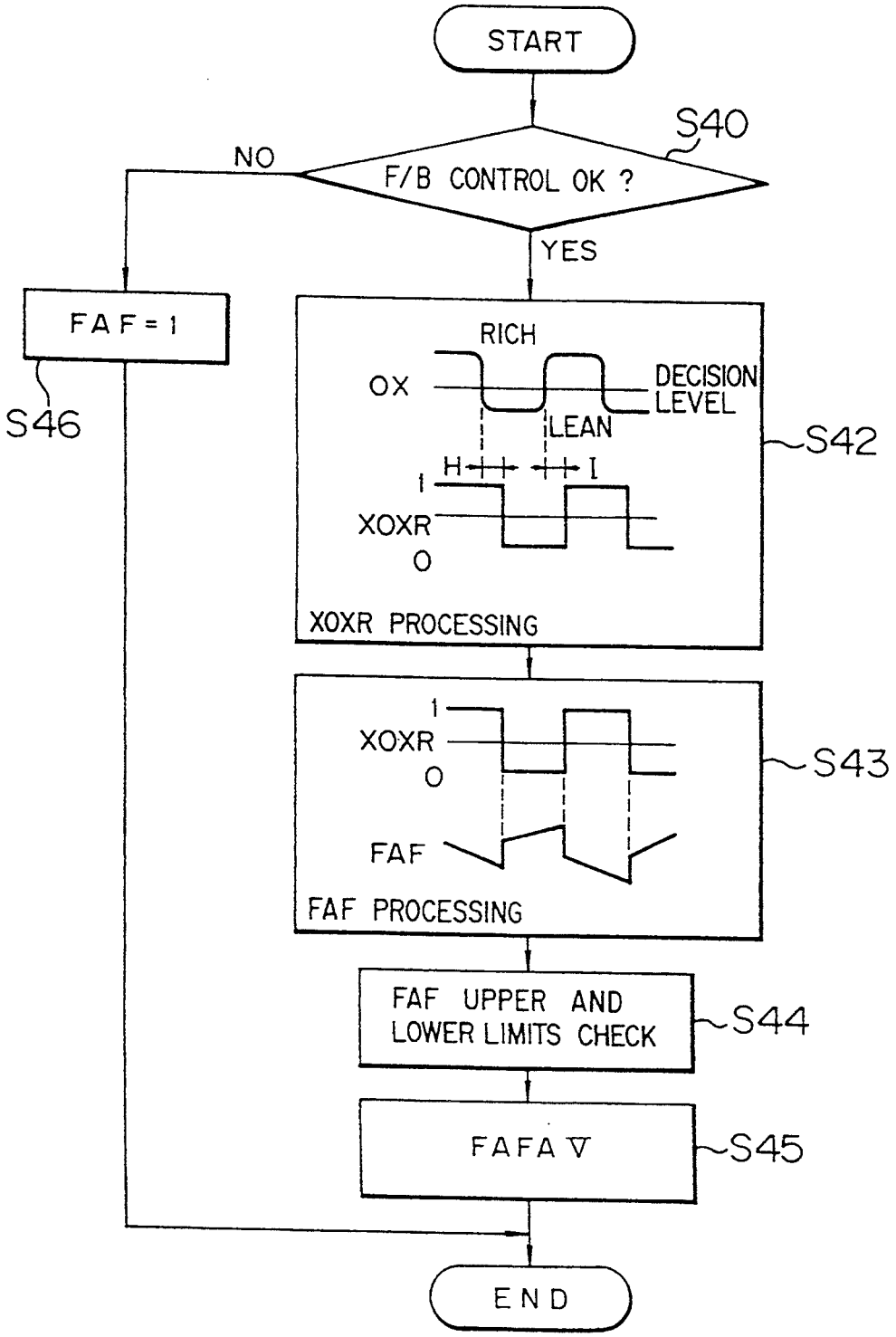
FIG. 4 is a flow chart showing air-fuel ratio feedback control in the embodiment.

In the step S106, it is determined whether the deviation from the reference value 1 of FAFAV obtained in the step S45 in FIG. 4 is at a predetermined value ($\omega$%) or higher, and the process is terminated as it is if it is not higher. When the deviation is more than $\omega$%, the process proceeds to a following step S108 and the evaporative concentration is detected. In the step S108, the evaporative concentration FGPG this time is obtained by adding that obtained by dividing the deviation from the reference value 1 of FAFAV by PGR to the preceding evaporative concentration FGPG. Accordingly, the value of the evaporative concentration FGPG in the present embodiment becomes 1 when the evaporative concentration in the bleedoff passage 15 is 0 (air is 100%), and is set to a value smaller than 1 as the evaporative concentration in the bleedoff passage 15 gets thicker. Here, it may also be arranged so as to obtain the evaporative concentration by replacing FAFAV with 1 in the step S108 shown in FIG. 10 so that the value of FGPG is set to a value larger than 1 as the evaporative concentration gets thicker.

Then, it is determined in a following step S109 whether the initial concentration detection end flag XNFGPG is 1, and the process proceeds to a following step S110 when it is not 1 and the process proceeds to a step S112 bypassing steps S110 and S111 when it is 1. In the step 110, it is determined whether the variation between the preceding detected value and the detected value this time of the evaporative concentration FGPG continues three times or more at a predetermined value ($\theta$%) or below and the evaporative concentration has been stabilized. When the evaporative concentration is stabilized, the process proceeds to the following step S111 and the initial concentration detection end flag XNFGPG is set to 1, and the process proceeds to the next step S112 thereafter. Further, when it is determined in the step S110 that the evaporative concentration has not been stabilized, the process proceeds to a step S112. In this step S112, a predetermined smoothing (e.g., 1/64 smoothing) computation is performed on the evaporative concentration FGPG this time for averaging, thereby to obtain an evaporative concentration mean value FGPGAV.

FUEL INJECTION QUANTITY CONTROL

Figure 11:
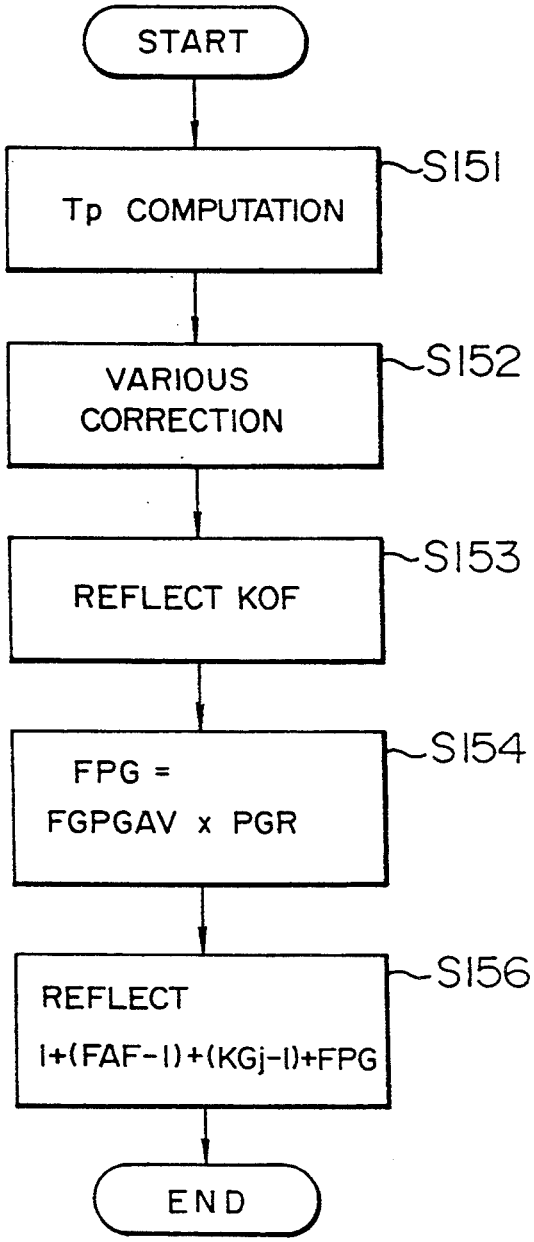
FIG. 11 is a flow chart showing fuel injection control in the embodiment.

Fuel injection control executed approximately every 4 ms in the base routine of the CPU 21 is shown in FIG. 11.

First, a basic fuel injection quantity (TP) is obtained by engine speed and load (such as pressure in the intake pipe) based on the data stored in the ROM 34 as a map in a step S151, and various basic corrections (such as cooling water temperature, after starting and intake air temperature) are made in a following step S152. Next, after reflecting a uniform control fuel correction factor KOF in FIG. 13 which will be described later in a step S153, the process proceeds to a step S154. In this step S154, a purge correction factor FPG is obtained by multiplying the evaporative concentration mean value FGPGAV by the purge rate PGR. Thereafter, in a following step S156, FAF, FPG and air-fuel ratio learning values ($KG_j$) in each engine operating area are obtained as correction factors through the computation of:

$$1+(FAF-1)+(KG_j-1)+FPG$$

thereby to reflect them to the fuel injection quantity TAU.

PURGE SOLENOID VALVE CONTROL

Figure 12:
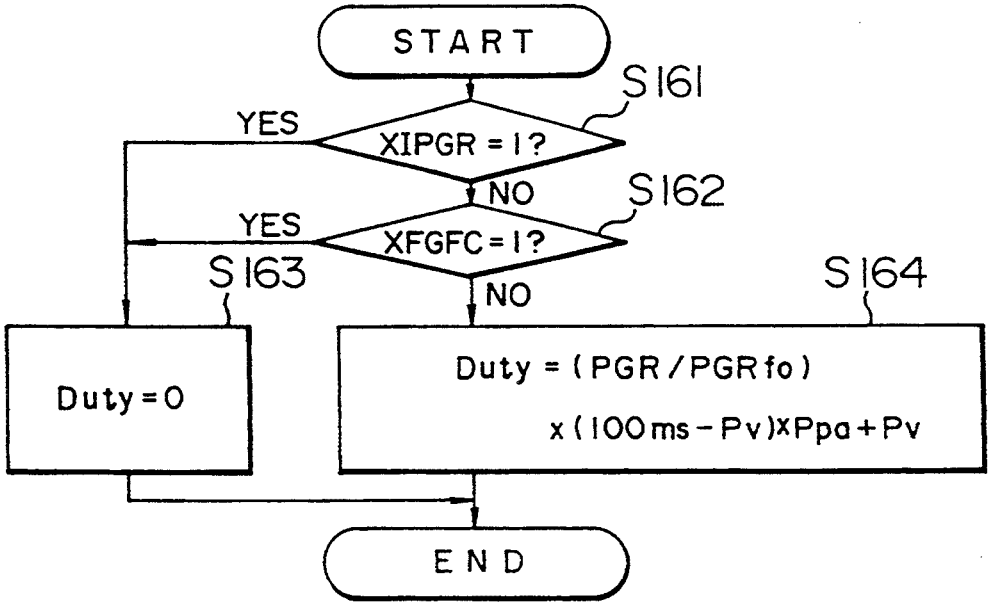
FIG. 12 is a flow chart showing purge solenoid valve control in the embodiment.

A purge solenoid valve control routine executed by time interruption at intervals of 100 ms by the CPU 21 is shown in FIG. 12. When the purge unexecuted flag XIPGR is 1 in a step S161 or when the purge stop flag XFGFC is 1 in a step S162, the process proceeds to a step S163 and Duty of the purge solenoid valve 16 is set to 0. Otherwise, the process proceeds to a step S164, and Duty of the purge solenoid valve 16 is obtained by an operation expression:

$$\text{Duty}=(PGR/PGR_{j0})\times(100\text{ ms}-Pv)\times P_{pa}+Pv$$

assuming that the drive period of the purge solenoid valve 16 is 100 ms. Where, PGR represents the purge rate obtained in FIG. 6, $PGR_{j0}$ represents a purge rate in each operating state when the purge solenoid valve 16 is fully opened (see FIG. 3), Pv represents a voltage correction value on the fluctuation of battery voltage, and $P_{pa}$ represents an atmospheric pressure correction value on the fluctuation of the atmospheric pressure.

AIR-FUEL RATIO LEARNING CONTROL

Figure 13:
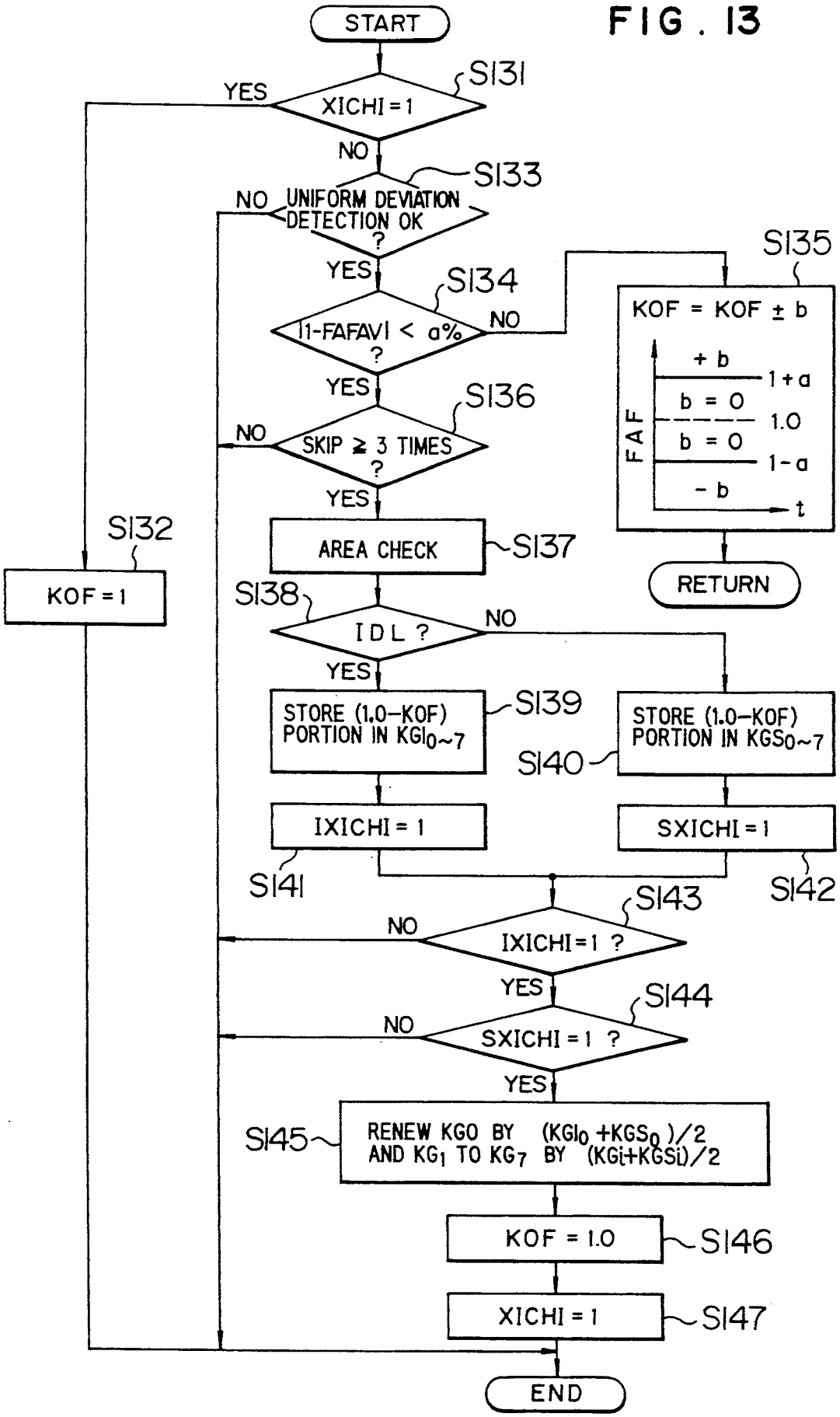
FIG. 13 is a flow chart showing air-fuel ratio learning control in the embodiment.

Next, an air-fuel ratio learning control routine executed whenever the FAF value skips is shown in FIG. 13. First, it is determined in a step S131 whether a uniform deviation detection end flag XICHI is 1 or not, and the process proceeds to a step S132 in case of 1, and a uniform control fuel correction factor KOF is set to a reference value 1. Here, it is sufficient that the uniform deviation detection end flag XICHI is initially set to 0 when the key switch is turned on. Further, when it is determined in the step S131 that the uniform deviation detection end flag XICHI is not 1, the process proceeds to a step S133 and it is determined whether uniform deviation detection is possible.

Here, in the step S133, it is determined that uniform deviation detection is possible when all the basic conditions, i.e., during air-fuel ratio feedback, cooling water temperature THW is 50° C. or higher, increase in fuel quantity after starting is 0, increase in fuel quantity of warming-up is 0, and battery voltage is 11.5 V or higher, are satisfied, and the process proceeds to a step S134 and is terminated as it is in case even any one of these conditions is not satisfied. Then, in the step S134, it is determined whether the deviation from the reference value 1 of FAFAV is at a predetermined value (a%) or below. The process proceeds to a step S135 when the deviation is not below a%, and the uniform control fuel correction factor KOF is corrected by increase or decrease by a predetermined quantity b at a time in accordance with the deviation of the FAF value from the reference value 1 with respect to the preceding uniform control fuel correction factor KOF, and the process is returned thereafter.

Further, when it is determined in the step S134 that the deviation from the reference value 1 of FAFAV is decreased to a predetermined value (a%) or below by the air-fuel feedback control in FIG. 4 as the result of adjustment of the uniform control fuel correction factor KOF in the step S135, the process proceeds to a step S136 and it is determined whether the FAF value has skipped three times or more. The process is terminated as it is when the FAF value has not skipped three times or more, and the process proceeds to a next step S137 when it has skipped three times or more, and the process proceeds further to a step S138 after the operating area at that time is checked.

Figures 9A, 9B, 9C, 9D:
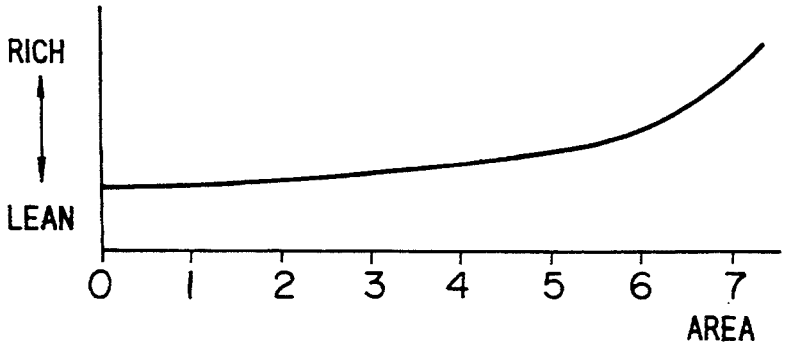
FIG. 9A, FIG. 9B and FIG. 9C are diagrams showing storage states of air-fuel ratio learning values $KGI_1$ to $KGI_7$, $KGS_1$ to $KGS_7$ and $KG_0$ to $KG_7$ in respective areas in the embodiment.
FIG. 9D is a rich-lean characteristic diagram in respective areas.

In the step S138, it is determined whether the engine 1 is in the idling area, and the process proceeds to a step S139 when the engine is in the idling area. Only the deviation portion from the reference value 1 of the uniform control fuel correction factor KOF is stored in a RAM 35 as idling time reacting air-fuel ratio learning values $KGI_0$ to $KGI_7$ in respective areas, and the idling time uniform deviation detection end flag IXICHI is set to 1 in a step S141 thereafter and the process proceeds to a step S143. Here, the idling time reacting air-fuel ratio learning values $KGI_0$ to $KGI_7$ in respective areas are divided into eight areas including the idling area $KGI_0$ in accordance with the engine speed NE and the intake pipe pressure as shown in FIG. 9A and stored in the RAM 35, and the storage quantity is varied by a preset value at a time in accordance with the characteristic shown in FIG. 9D with the idling area $KGI_0$ as the center.

Further, when it is determined in a step S138 that the engine 1 is not in the idling area, the process proceeds to a step S140, and, after only the deviation portion from the reference value 1 of the uniform control fuel correction factor KOF is stored in the RAM 35 as non-idling time reacting air-fuel ratio learning values $KGS_0$ to $KGS_7$ in respective areas, a non-idling time uniform deviation detection end flag SXICHI is set to 1 in a step S142 and the process proceeds to a step S143. Here, the non-idling time reacting air-fuel ratio learning values $KGS_0$ to $KGS_7$ in respective areas are divided into eight areas including the idling area $KGS_0$ in accordance with the engine speed NE and the intake pipe pressure as shown in FIG. 9B and stored in the RAM 35, and the storage quantity is arranged to be varied by a preset value at a time in accordance with the characteristic shown in FIG. 9D with the area at time of area check in a step S137 as the center.

Then, it is determined in a step S143 whether the idling time uniform deviation detection end flag IXICHI is 1, and the process proceeds to a step S144 when it is 1 and is terminated as it is when it is not 1. Further, it is determined in the step S144 whether the non-idling time uniform slippage detection end flag XICHI is 1, and the process proceeds to a step S145 when it is 1 and is terminated as it is when it is not 1. In the step S145, after air-fuel ratio learning values $KG_0$ to $KG_7$ in respective areas are renewed by the value obtained by leveling the idling time reacting air-fuel ratio learning values $KGI_0$ to $KGI_7$ in respective areas and the non-idling time reacting air-fuel ratio learning values $KGS_0$ to $KGS_7$ in respective areas with respect to each area, the process proceeds to a step S146, where the uniform control fuel correction factor KOF is returned to the reference value 1. Further, after the uniform deviation detection end flag XICHI is set to 1 in a step S147 so that learning value renewal by area may be executed, the process is terminated. Here, the air-fuel ratio learning values $KG_0$ to $KG_7$ in respective areas are also divided into eight areas including the idling area $KG_0$ in accordance with the engine speed NE and the intake pipe pressure as shown in FIG. 9C, and are stored in the RAM 35.

LEARNING VALUE RENEWAL BY AREA

Figure 14:
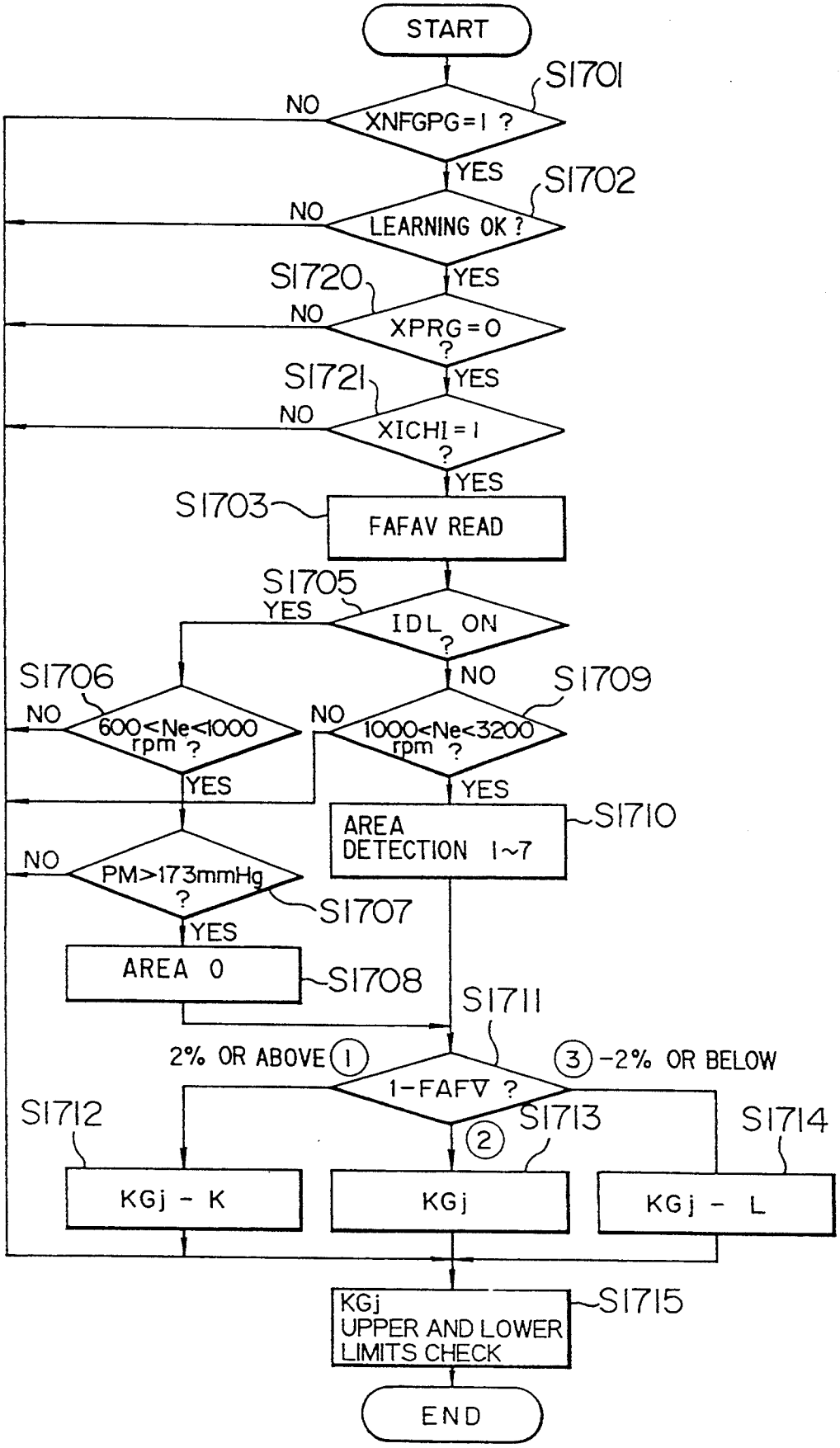
FIG. 14 is a flow chart showing learning value renewal by area in the embodiment.

Next, a learning value renewal by area routine executed every time the FAF value skips is shown in FIG. 14. First, it is determined in a step S1701 whether an initial concentration detection end flag XNFGPG is 1, and the process is terminated as it is in case XNFGPG is not 1. In case it is 1, the process proceeds to a next step S1702. It is determined in the step S1702 whether all of the basic conditions, i.e., during air-fuel ratio feedback, the cooling water temperature THW is 80° C. or higher, quantity of fuel increase after starting is 0, quantity of fuel increase in warming-up is 0, the FAF value has skipped five times or more after entering into the present operating area, and the battery voltage is 11.5 V or higher are satisfied. The process is terminated as it is when any one of the basic conditions is not satisfied, and the process proceeds to a next step S1720 when all the conditions are satisfied.

In the step S1720, it is determined whether purging by a purge solenoid valve 16 has not been executed by a fact whether a purge execution flag XPRG is 0 or not. When purging has been executed, the process is terminated as it is, and, when purging has not been executed, the process proceeds to a next step S1721, where it is determined whether uniform deviation detection has been terminated by a fact whether the uniform deviation detection end flag XICHI is 1 or not, and the process is terminated as it is when uniform deviation detection has not been terminated, and proceeds to a step S1703 when uniform deviation detection has been terminated and learning control by area is performed.

After the FAFAV value is read in the step S1703, learning control is performed for the idle time $KG_0$ (a step S1708) and the running time (a step S1710) depending on the result of determination on idle or not in a step S1705, and is performed separately in a predetermined number (7 for instance) of areas $KG_1$ to $KG_7$ depending on the load (e.g., pressure in the intake pipe) at time of running. Further, the learning value may be renewed in the steps S1706 and S1709 only within a predetermined engine speed (600 to 1,000 rpm at idle time, and 1,000 to 3,200 rpm at running time). Furthermore, the learning value is renewed at idle time in a step S1707 when the intake pipe pressure PM is 173 mmHg or higher.

The method of renewing learning values $KG_0$ to $KG_7$ in respective areas is performed by increasing or decreasing the learning values $KG_0$ to $KG_7$ in these areas by predetermined values ($K\% < L\%$) at a time when the difference between the smoothed value FAFAV of FAF and the reference value 1.0 is larger than a predetermined value (2% for instance) (steps S1711 to S1714). Finally, upper and lower limits of $KG_j$ are checked (a step S1715). Here, the upper limit value of $KG_j$ is set to 1.2 and the lower limit value thereof is set to 0.8 for instance, and it is also possible to set these upper and lower limit values for every engine operating area. Besides, it is a matter of course that the learning values $KG_0$ to $KG_7$ in respective areas are stored in the RAM 35 (learning value storage means) backed up by a power source so as to hold storage values even after the key switch is disconnected.

(OTHER EMBODIMENTS)

Figure 15:
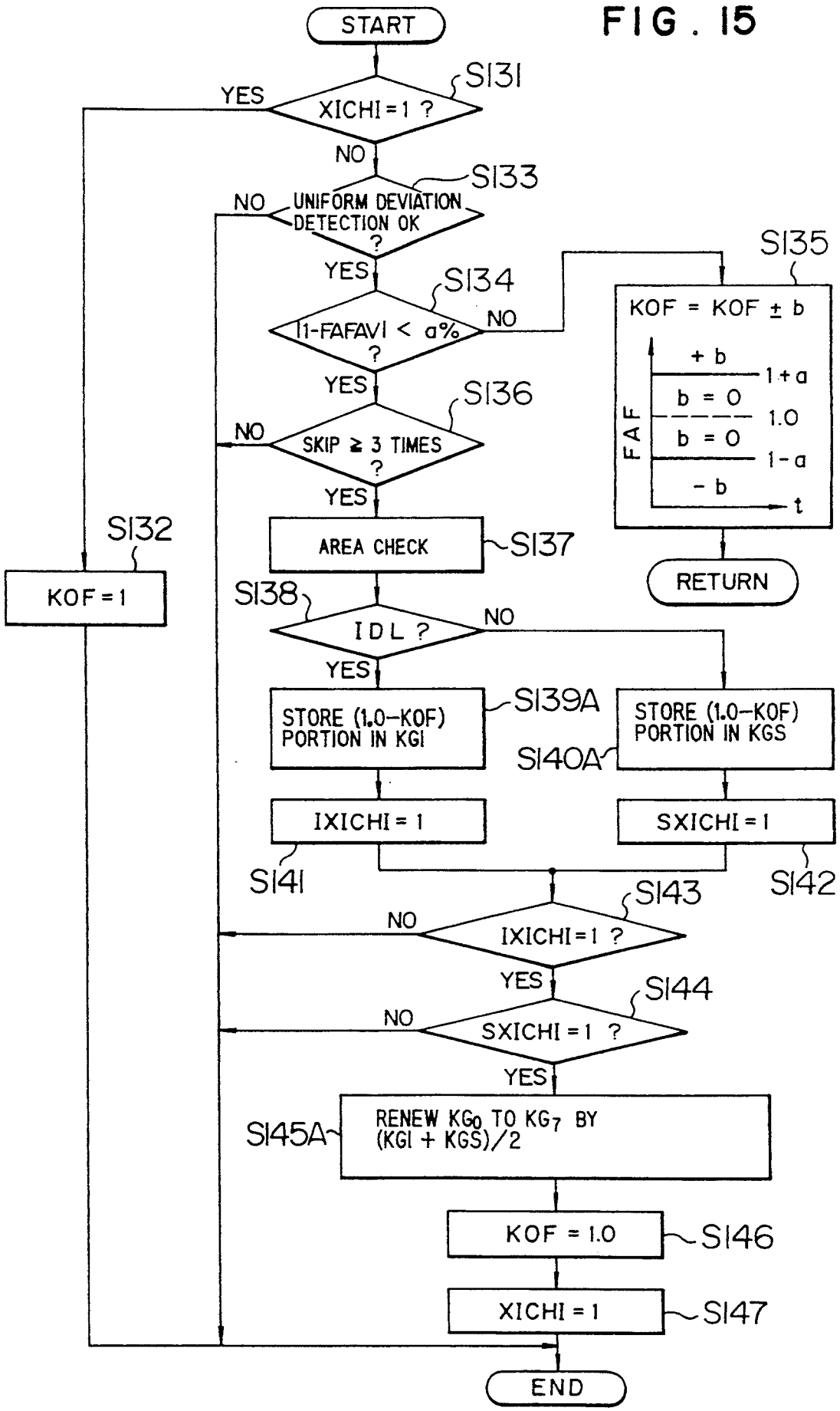
FIG. 15 is a flow chart showing air-fuel ratio learning control in a second embodiment of an apparatus of the present invention.

FIG. 15 shows a second embodiment of the present invention, in which only one each of the air-fuel ratio learning values KGI and KGS in idle and non-idle are stored in the RAM 35 in steps S139A and S140A in place of the steps S139 and S140 as against the embodiment shown in FIG. 13 as the air-fuel ratio learning control routine, and, after leveling the air-fuel ratio learning values KGI and KGS at idle time and non-idle time in a step S145A in place of the step S145 in keeping with the above, the air-fuel ratio learning values $KG_0$ to $KG_7$ in respective areas are renewed in accordance with the values obtained by varying the leveled value by a preset value at a time according to the characteristic shown in FIG. 9D.

Figure 16:
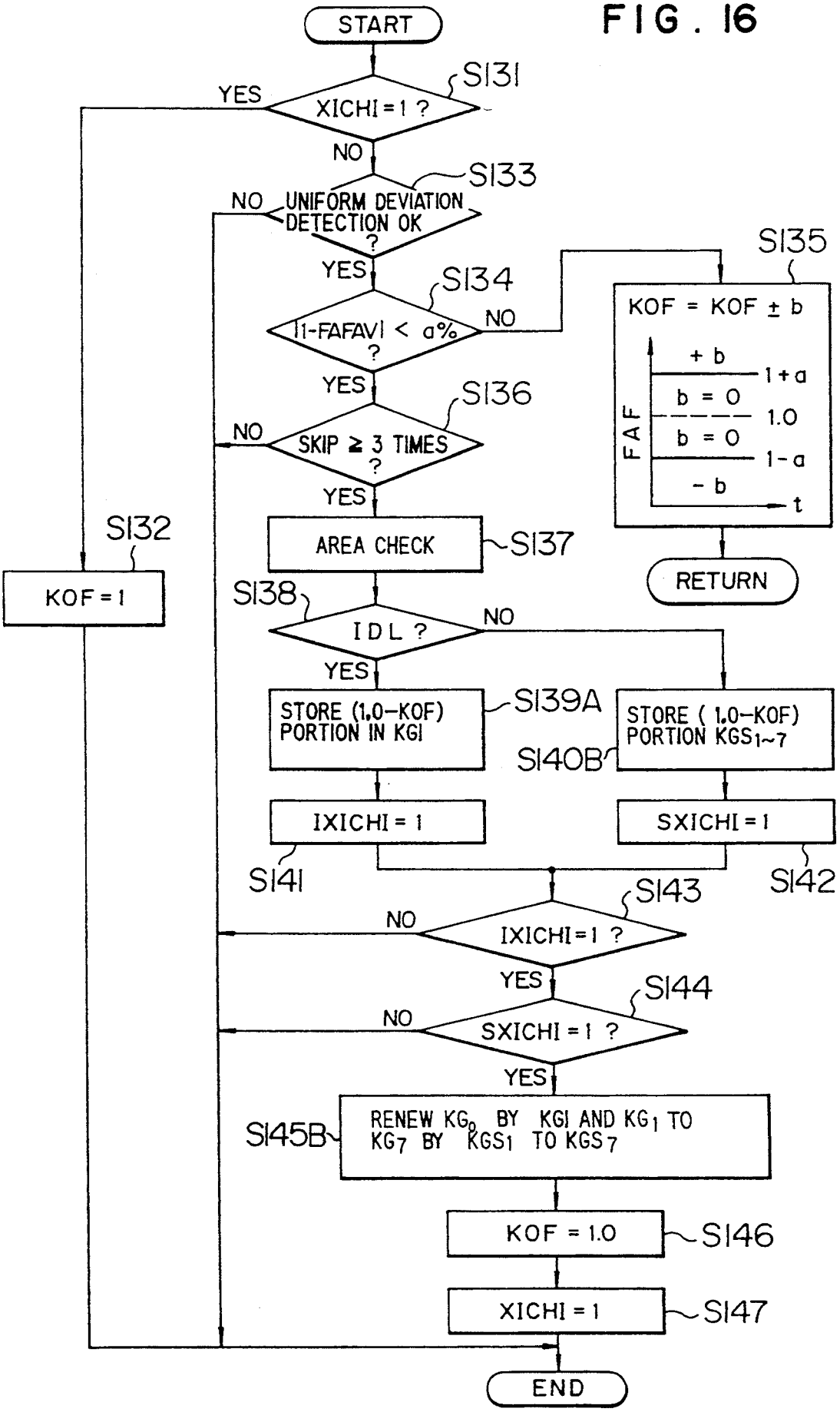
FIG. 16 is a flow chart showing air-fuel ratio learning control in a third embodiment of an apparatus of the present invention.

FIG. 16 shows a third embodiment of the present invention, in which only one air-fuel ratio learning value $KG_1$ in idle is stored in the RAM 35 in a step S139A in place of the step S139 as against the embodiment shown in FIG. 13 as the air-fuel ratio learning control routine, the air-fuel ratio learning values $KG_1$ to $KG_7$ in respective areas at non-idling time except idling time are stored in the RAM 35 in a step S140B in place of the step S140, the air-fuel ratio learning values $KG_0$ at idle time only is renewed by the air-fuel ratio learning value $KG_1$ at idle time in a step S145B in place of the step S145, and the air-fuel ratio learning values $KG_1$ to $KG_7$ in respective areas at non-idling time are renewed by the air-fuel ratio learning values $KG_1$ to $KG_7$ in respective areas at non-idling time.

Figure 17:
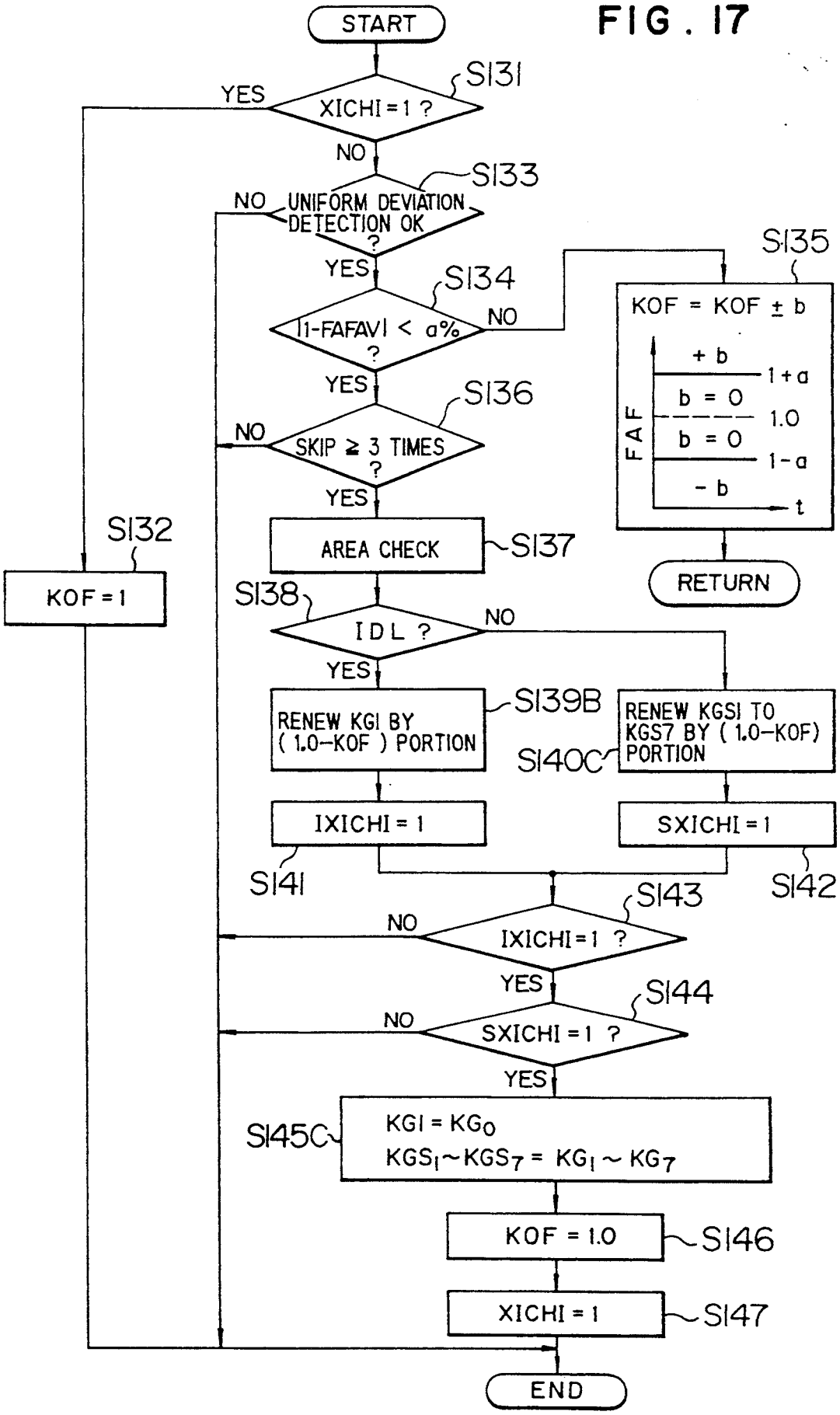
FIG. 17 is a flow chart showing air-fuel ratio learning control in a fourth embodiment of an apparatus of the present invention.

FIG. 17 shows a fourth embodiment of the present invention, in which, as the air-fuel ratio learning control routine, only one air-fuel ratio learning value $KG_1$ is renewed in a step S139B in place of the step S139 as against the embodiment shown in FIG. 13, the air-fuel ratio learning values $KG_1$ to $KG_7$ in respective areas at non-idling time except idling time are renewed in a step S140C in place of the step S140, and the air-fuel ratio learning value $KG_1$ at idling time is adopted as the air-fuel ratio learning value $KG_0$ in a step S145C in place of the step S145, and the air-fuel ratio learning values $KG_1$ to $KG_7$ in respective areas at non-idling time are adopted as the air-fuel ratio learning values $KG_1$ to $KG_7$ in respective areas at non-idling time in keeping with the above. According to the fourth embodiment, only one air-fuel ratio learning value $KG_1$ in idling and the air-fuel ratio learning values $KG_1$ to $KG_7$ in respective areas at non-idling time are stored in a RAM backed up by a power source so as to hold storage values even after the key switch is disconnected, and these backed up respective learning values KGI and $KG_1$ to $KG_7$ may be replaced as the air-fuel ratio learning values $KG_1$ to $KG_7$ in respective areas when the key switch is put on.

Further, in respective embodiments described above, uniform deviation of the air-fuel ratio is detected in one area each at idling time and non-idling time, but it may be also arranged so as to detect uniform deviation of the air-fuel ratio in a plurality of areas at non-idling time.

We claim:

1. An air-fuel ratio control apparatus of an internal combustion engine for storing evaporated fuel generated in a fuel tank in a canister and purging off the evaporated fuel stored in the canister to an intake side of the internal combustion engine through a blow-off passage together with air, comprising:

air-fuel ratio detecting means for detecting an air-fuel ratio of said internal combustion engine;

air-fuel ratio feedback means for making feedback control of the air-fuel ratio of the air-fuel mixture supplied to the internal combustion engine in accordance with the air-fuel ratio detected by the air-fuel ratio detecting means;

a flow rate control valve for changing a purge rate of air containing the evaporated fuel purged off to the intake side of said internal combustion engine from said canister through said blow-off passage;

purge rate control means for controlling the purge rate by said flow rate control valve in accordance with the state of the engine;

concentration detecting means for detecting the concentration of said evaporated fuel;

purge reacting fuel quantity correcting means for correcting the fuel quantity so that the air-fuel ratio shows a predetermined value in accordance with the evaporated fuel concentration detected by said concentration detecting means and the purge rate by said purge rate control means;

operating area detecting means for detecting a plurality of operating areas including idling and non-idling of the internal combustion engine;

learning value storage means for storing air-fuel ratio learning values in accordance with a plurality of operating areas including idling and non-idling of the internal combustion engine;

deviation detecting means for detecting the deviation by comparing an air-fuel ratio feedback value by said air-fuel ratio feedback means with a reference value;

uniform learning control means for increasing or decreasing fuel quantity so that the deviation from the reference value detected by said deviation detecting means shows a predetermined value or below at both times when the operation state of an internal combustion engine is detected to be idling and when it is detected to be non-idling by said operating area detecting means before purge rate control is started by said purge rate control means;

uniform learning value renewal means for renewing learning values of said learning value storage means based on increase and decrease quantity of fuel of said uniform learning control means when said deviation shows a predetermined value or below at both times when the operation state of an internal combustion engine is detected to be idling and when it is detected to be non-idling by said operating area detecting means by increase and decrease of fuel quantity by the uniform learning control means;

purge start permit means for permitting the start of purge rate control by said purge rate control means after renewal of the learning value by the uniform learning value renewal means; and learning value renewal by area means for renewing learning values of said learning value storage means by area based on the air-fuel ratio feedback value by said air-fuel ratio feedback control means after renewal of the learning values by said uniform learning value renewal means.

2. An air-fuel ratio control apparatus according to claim 1, wherein said uniform learning value renewal means is adapted to store learning values of both in idling and non-idling in a learning area at times of idling and non-idling and to level these learning values so as to renew learning values in respective areas.

3. An air-fuel ratio control apparatus according to claim 1, wherein said uniform learning value renewal means is adapted to store only one each of learning values in idling and non-idling, and to renew learning values in respective areas using a value obtained by leveling these two learning values.

4. An air-fuel ratio control apparatus according to claim 1, wherein said uniform learning value renewal means is adapted to store only one learning value in idling and learning values in respective areas at non-idling time except idling, and to renew learning values in corresponding areas with the learning values in these respective areas.

5. An air-fuel ratio control apparatus according to claim 1, wherein said uniform learning value renewal means is adapted to renew only one learning value in idling, learning values in respective areas at non-idling time except idling are renewed in non-idling, and to learn individually on areas with the renewed learning values as the learning values in respective areas.

* * * * *